US008241491B1

(12) United States Patent
Zaid et al.

(10) Patent No.: US 8,241,491 B1
(45) Date of Patent: Aug. 14, 2012

(54) METHOD OF REMOVING ARSENIC FROM HYDROCARBONS

(75) Inventors: Gene H. Zaid, Sterling, KS (US); Beth Ann Wolf, Hutchinson, KS (US)

(73) Assignee: JaCam Chemicals, LLC, Sterling, KS (US)

( * ) Notice: Subject to any disclaimer, the term of this patent is extended or adjusted under 35 U.S.C. 154(b) by 0 days.

(21) Appl. No.: 13/251,224

(22) Filed: Oct. 1, 2011

(51) Int. Cl.
*C10G 21/20* (2006.01)
*C10G 21/16* (2006.01)

(52) U.S. Cl. ..... 208/251 R; 208/290; 208/326

(58) Field of Classification Search ..... 208/251 R, 208/289, 291, 298, 311, 322, 323, 325, 326, 208/330, 333, 334
See application file for complete search history.

(56) References Cited

U.S. PATENT DOCUMENTS

| | | | | |
|---|---|---|---|---|
| 3,542,669 | A | 11/1970 | DeFeo | |
| 3,782,076 | A | 1/1974 | Carr et al. | |
| 4,849,577 | A | 7/1989 | Boitiaux et al. | |
| 4,978,512 | A * | 12/1990 | Dillon | 423/226 |
| 5,169,516 | A | 12/1992 | Carr | |
| 5,354,453 | A * | 10/1994 | Bhatia | 208/236 |
| 5,744,024 | A * | 4/1998 | Sullivan et al. | 208/236 |
| 6,063,346 | A * | 5/2000 | Luna | 423/220 |
| 2003/0150779 | A1 * | 8/2003 | Collins et al. | 208/251 R |

* cited by examiner

*Primary Examiner* — Walter D Griffin
*Assistant Examiner* — Renee E Robinson
(74) *Attorney, Agent, or Firm* — Hovey Williams LLP

(57) ABSTRACT

Improved methods for removing arsenic from starting liquid hydrocarbons are provided which comprise contacting the hydrocarbons with a composition containing a triazine component and a glycol ether component, allowing the composition to react with the arsenic to create a treated hydrocarbon fraction and an arsenic-rich fraction, and separating the treated fraction from the arsenic-rich fraction. Preferably, the treating composition also includes an alcohol, and is used at a level of from about 1-10,000 ppm.

25 Claims, No Drawings

METHOD OF REMOVING ARSENIC FROM HYDROCARBONS

BACKGROUND OF THE INVENTION

1. Field of the Invention

The present invention is broadly concerned with methods for scavenging and removal of arsenic and arsenic compounds from hydrocarbons in order to reduce substantially reduce the arsenic content of the hydrocarbons below commercially acceptable levels. More particularly, the invention is concerned with such methods making use of an effective amount of a composition comprising a triazine and a glycol ether, wherein the compositions are contacted with dewatered liquid hydrocarbon (e.g., crude or condensate oil containing no more than about 5% by volume water), preferably with agitation and subsequent settling, followed by separation of the treated hydrocarbon and a minor arsenic-rich aqueous fraction.

2. Description of the Prior Art

Oils and other hydrocarbons can contain significant quantities of arsenic, typically in the form of various arsenic compounds. Arsenic in this form is highly toxic and stringent government regulations prohibit the sale of oils containing high quantities of arsenic. Furthermore, it is known that the presence of arsenic in gasolines can cause permanent deactivation of catalysts in automotive pollution abatement catalytic converters. Accordingly, there exists a need to rapidly and economically scavenge arsenic from hydrocarbons containing unacceptably high quantities of arsenic.

A number of techniques have been proposed in the past to reduce the arsenic content of hydrocarbons. U.S. Pat. No. 3,782,076 describes a process for reducing the arsenic content of gaseous hydrocarbons by contacting the gas with a sorbent comprising a lead oxide. However, this technique is not suitable for liquid hydrocarbons.

U.S. Pat. No. 3,542,669 describes the removal of arsenic and arsenic derivatives from petroleum feedstreams by contacting the feedstreams with a lignite-based activated carbon. U.S. Pat. No. 4,849,577 teaches that arsenic and carbon oxysulfides may be removed from hydrocarbon cuts by liquid phase contact between the cuts and lead oxide. U.S. Pat. No. 5,169,516 advocates serial catalytic oxidation of hydrocarbon streams using a Cu/Zn/Al2O3 catalyst. However, these proposals involve rather complicated and expensive equipment, and are not suited for on-site or oil field treatment of arsenic-laden liquid hydrocarbons.

SUMMARY OF THE INVENTION

The present invention overcomes the problems outlined above and provides a simple, low-cost method for removing arsenic (as used herein, "arsenic" refers to elemental arsenic, and all arsenic compounds and derivatives thereof) from liquid hydrocarbons of all types. Generally speaking, the method of the invention involves contacting such a liquid hydrocarbon which has been dewatered or otherwise has a maximum water content of up to about 5% by volume with a composition comprising a triazine/glycol ether arsenic-scavenging composition. In preferred practice, the composition is simply mixed with the liquid hydrocarbon under ambient conditions with mild agitation, followed by settling to yield a treated liquid hydrocarbon fraction of reduced arsenic content and an arsenic-rich fraction. The two fractions are then separated, with the hydrocarbon fraction being suitable for further processing or sale, whereas the arsenic-rich fraction is sent to disposal.

In preferred forms of the invention, the compositions should contain from about 25-80% by volume triazine (which normally contains a number of triazine compounds), from about 15-50% by volume glycol ether (typically comprising a number of ether species and/or derivatives), and optionally from about 5-40% by volume of one or more alcohols (e.g., C1-C18 mono- or poly-alcohols). The compositions of the invention are preferably in the form of mixed liquids and are used at a level of from about 1-10,000 ppm, based upon the volume of the starting hydrocarbon to be treated, more preferably from about 1,500-8,000 ppm, and most preferably from about 4,000-6,000 ppm.

DETAILED DESCRIPTION OF THE PREFERRED EMBODIMENT

The present invention provides liquid arsenic-scavenging blended compositions comprising a quantity of one or more triazines, and a quantity of one or more glycol ethers. The compositions are water-dispersible and oil soluble, and have a minor amount of water therein with a maximum water content of about 15%, more preferably about 10%, by volume. The compositions provide excellent arsenic-scavenging in the context of arsenic removal from liquid hydrocarbons of low moisture content, such as crude or refined oil, or oil condensate from natural gas production.

The Triazine Component

The triazines useful in the invention include the three isomers of triazine (1,2,3-, 1,2,4-, and 1,3,5-triazine) as well as derivatives thereof, which may be aromatic or non-aromatic. For example, some of the useful triazines are represented by the structural formula

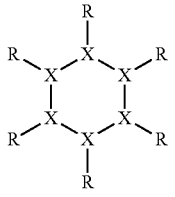

where three of the X members of the ring are nitrogen and the remaining X members of the ring are carbon, each R substituent bound to a nitrogen member being independently selected from the group consisting of nothing (i.e., it does not exist), H, C1-C20 straight or branched chain alkyl, alkenyl, and alkynyl groups, and hydroxyl derivatives of such groups, and each R substituent bound to a carbon member is independently selected to the group consisting of H, C1-C20 straight or branched chain alkyl, alkenyl, and alkynyl groups, and hydroxyl derivatives of such groups. Mixtures of various triazines may also be used. In preferred forms, the isomers of triazine are used, meaning that each of the R substituents bound to a nitrogen is nothing, and each of the R substituents bound to a carbon is H. These preferred triazines are aromatic in character. Other useful triazines are those fully described in U.S. Pat. No. 7,438,877, namely triazine derivatives having both hydroxyalkyl and alkylamine functionalities made by reacting an alkanolamine, at least one alkyl amine, and an aldehyde. This patent is incorporated by reference in its entirety herein.

Preferably, the triazine component is the reaction product of an alkanolamine and an aldehyde, advantageously the lower alkanolamines (i.e., the C1-C6 alkanolamines) and the lower aldehydes (i.e., the C1-C6 aldehydes), where in both cases the C1-C6 moiety is a straight or branched chain alkyl group. The most preferred reactants are monoethanolamine and formaldehyde. The reaction products comprise primarily a mixture of one or more triazines and a bisoxoazolidine, although other intermediates and/or polymers thereof may be present. Where monoethanolamine and formaldehyde are the reactants, the reaction products are chiefly 1,3,5-tri-(2-hydroxymethyl)-hexahydro-S-triazine, N,N-methylene bisoxoazolidine, and mixtures thereof. The relative amounts of the reaction products depend on the stoichiometry of the reaction, and the stoichiometry can be adjusted to thereby determine the respective quantities of the reaction products. In the case of a monoethanolamine/formaldehyde reaction, the molar ratio of monoethanolamine to formaldehyde is from about 1:0.25 to about 1:10, and preferably from about 1:1 to about 1:1.5. Further details regarding the preferred synthesis of the triazines can be found in U.S. Pat. No. 4,978,512, incorporated herein in its entirety.

In practice, the triazine employed in the invention is a modified form of a triazine commercialized by JaCam Chemical Co. of Sterling, Kans. under the designation "WGS 50WC H2S Scavenger." This product as sold contains approximately 70% water, has a density of 9.1 lbs./gal, a specific gravity of 1.06-1.12, and a pH of 10-11.5.

In order to render this commercial product suitable for the invention, it is necessary to remove a substantial fraction of the water. This is preferably accomplished by heating the commercial product under vacuum, e.g., heating to a temperature of about 120-200° F. (more preferably from about 140-180° F., most preferably about 160° F.), under a vacuum of from about 10-29 in. Hg (more preferably from about 15-25 in. Hg), for a time of from about 1-6 hours (more preferably from about 2-4 hours). However accomplished, the final triazine will have a minor amount of water therein, and up to about 15% by volume, as noted previously.

The triazine component should be present in the overall compositions of the invention at a level of from about 25-80% by volume, and more preferably from about 40-60% by volume.

The Glycol Ether Component

The glycol ethers usable in the compositions of the invention are preferably selected from the group consisting of glycol mono-, di-, and tri-alkylene ethers, glycol aryl ethers, derivatives of the foregoing, and mixtures thereof, where the alkylene groups may be straight or branched chain, and the aryl groups may be any aromatic species, such as mono- or poly-phenyls. The derivatives may again be any form of the foregoing ethers, such as the acetates, acylates, amides, nitriles, and ethoxylates (where the level of ethoxylation varies from about 1-30 moles, more preferably from about 3-10 moles, of ethylene oxide per mole of glycol ether). The single most preferred glycol ether for use in the invention is glycol butyl ether, also known as 2-butoxyethanol, CAS #111-76-2. However, other glycol ethers may also be used, alone or in combination, such as the exemplary glycols set forth in the Table below.

| Chemical | Chemical Synonym | CAS # |
|---|---|---|
| Ethylene glycol monomethyl ether (EGME) | 2-methoxyethanol | 109-86-4 |
| Ethylene glycol monoethyl ether (EGEE) | 2-ethoxyethanol | 110-80-5 |
| Ethylene glycol monoethyl ether acetate (EGEEA) | 2-ethoxyethanol acetate<br>2-ethoxyethyl acetate | 111-15-9 |
| Ethylene glycol monobutyl ether acetate (EGBEA) | 2-butoxyethanol acetate<br>Butyl glycol acetate<br>2-butoxyethyl acetate | 112-07-2 |
| Ethylene glycol monopropyl ether (EGPE) | 2-propoxyethanol | 2807-30-9 |
| Ethylene glycol monophenyl ether (EGPhE) | 2-phenoxyethanol | 122-99-6 |
| Ethylene glycol monohexyl ether (EGHE) | 2-hexyloxyethanol | 112-25-4 |
| Ethylene glycol mono 2-ethylhexyl ether | 2-(2-ethylhexyloxy) ethanol | 1559-35-7 |

The glycol component is normally present in the compositions of the invention at a level of from about 15-50% by volume, and more preferably from about 20-40% by volume.

The Optional Alcohol Component

The alcohol component, when used, is preferably an organic mono- or poly-alcohol including a C1-C18 organic moiety. More preferably, the alcohol is a C1-C6 mono-alcohol, where the C1-C6 group is a straight or branched chain alkyl group. The most preferred alcohols are selected from methanol, ethanol, propanol, butanol, and mixtures thereof, with methanol normally being used.

The Preferred Arsenic-Scavenging Compositions

The single most preferred composition in accordance with the invention is a blend containing 50% by volume of the dewatered WGS 50WC H2S Scavenger product having a moisture content of up to about 10% by volume, 30% by volume of ethylene glycol monobutyl ether, and 20% by volume methanol. The composition is clear, has an aromatic odor, a pour point of −29° F., a flash point of 54° F., density of 9.1 lbs./gal, specific gravity of 1.00-1.05, and a pH of 10.0-11.5.

As outlined above, however, the compositions of the invention are not limited to this preferred formulation, but may have the described ranges of triazine, ether, and alcohol (when used). Additionally, the pH of the compositions may be variable, and may range from about 6-13, more preferably from about 9-12.

The compositions of the invention are also oil soluble, in order to ensure that the compositions blend into liquid hydrocarbon products for maximum scavenging of arsenic. The property of oil solubility in the context of the present compositions is conveniently determined using a xylene solubility test. This test involves mixing 25 ml of xylene with 75 ml of the composition. The mixture is then placed in a freezer at −30° F. overnight. After this treatment, the product is removed from the freezer and allowed to come to ambient temperature. If there is no separation of the ingredients, the composition is considered to be oil soluble.

Arsenic-Scavenging Methods

In carrying out the methods of the invention, an effective amount of a composition in accordance with the invention is contacted with a starting liquid hydrocarbon containing arsenic, followed by allowing the composition to scavenge or sequester at least a portion of the arsenic in the starting liquid hydrocarbon. The starting liquid hydrocarbon should have only a small proportion of residual water, up to a maximum of about 5% by volume, and more preferably up to about 1% by volume. Such contact between the low water content starting hydrocarbon and the compositions of the invention yields a treated liquid hydrocarbon fraction having a reduced arsenic content, and an arsenic-rich aqueous fraction. Thereafter, the treated liquid hydrocarbon fraction is separated from the arsenic-rich fraction. In general, the compositions of the invention are believed to sequester or scavenge arsenic or arsenic compounds in the starting liquid hydrocarbon, and are dispersed in the residual water of the starting hydrocarbon.

In particularly preferred techniques, the compositions of the invention are added to a tank containing the starting liquid hydrocarbon, followed by agitation for a period of time (preferably for a period of from about 0.5-12 hours, and more preferably for a period of from about 1-4 hours), the agitated liquid hydrocarbon is then allowed to settle to form the arsenic-depleted and arsenic-rich fractions (preferably for a period of from about 0.5-12 hours, and more preferably for a period of from about 1-4 hours). The treated liquid hydrocarbon fraction is then withdrawn from the tank, and the aqueous, arsenic-rich fraction bottoms is discarded.

In terms of use, the composition of the invention should be present at a level of from about 2.5-25 ppm per barrel of hydrocarbon in the starting liquid, and more preferably at a level of from about 5-15 ppm.

EXAMPLE

Three separate 400-barrel tanks containing dehydrated condensate oil were treated in accordance with the invention. The treatment involved adding approximately 5,000 ppm of the preferred three-component composition of the invention to each tank (which amounted to about 84 gallons of the liquid composition), followed by mild agitation under ambient conditions over a period of about 2-3 hours, with subsequent settling for a period of about 2 hours, to create a preponderant oil fraction of reduced arsenic content, and a minor aqueous bottoms fraction rich in arsenic. The preponderant oil fraction was then transferred to a sale tank, and the bottoms fraction was drained for disposal.

The condensate in Tank 1 had a starting arsenic content of 6.54 ppm, which was reduced by the treatment to 0.645 ppm. In Tank 2, the starting arsenic content was 74.9 ppm, which was reduced to 0.759 ppm. In Tank 3, the starting arsenic content was 129 ppm, which was reduced to 0.781 ppm. These reduced arsenic levels permitted normal commercial sale of the treated oil.

We claim:

1. A method of removing arsenic from a starting liquid hydrocarbon containing arsenic and up to about 5% by volume water, comprising the steps of contacting said starting liquid hydrocarbon with an effective amount of a composition comprising from about 25-80% by volume of a triazine and from about 15-50% by volume of a glycol ether, allowing said composition to sequester at least a portion of said arsenic in said starting liquid hydrocarbon, resulting in a treated liquid hydrocarbon fraction having a reduced arsenic content, and an arsenic-rich fraction, and separating said treated liquid hydrocarbon fraction from said arsenic-rich fraction, said composition being used at a level of from about 1-10,000 ppm, based upon the volume of said starting liquid hydrocarbon.

2. The method of claim 1, said water content being up to about 1% by volume.

3. The method of claim 1, including the step of adding said composition to said starting liquid hydrocarbon to form a mixture, agitating said mixture for a period of time, and allowing the agitated mixture to settle and thereby form said treated liquid hydrocarbon fraction and said arsenic-rich fraction.

4. The method of claim 3, including the step of agitating said mixture for a period of from about 0.5-12 hours.

5. The method of claim 3, including the step of allowing said agitated mixture to settle for a period of from about 0.5-12 hours.

6. The method of claim 1, said level being from about 1,500-8,000 ppm.

7. The method of claim 6, said level being from about 4,000-6,000 ppm.

8. The method of claim 1, said triazine level being from about 40-60% by volume.

9. The method of claim 1, said glycol ether level being from about 20-40% by volume.

10. The method of claim 1, said composition including a quantity of alcohol.

11. The method of claim 10, said alcohol being present at a level of from about 5-40% by volume.

12. The method of claim 11, said level being from about 15-30% by volume.

13. The method of claim 10, said alcohol being a lower alcohol.

14. The method of claim 13, said lower alcohol selected from the group consisting of C1-C6 alkyl alcohols and mixtures thereof.

15. The method of claim 14, said alcohol comprising methanol.

16. The method of claim 1, said triazine having the structural formula

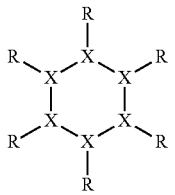

where three of the X members of the ring are nitrogen and the remaining X members of the ring are carbon, each R substituent bound to a nitrogen member being independently selected from the group consisting of nothing, H, C1-C20 straight or branched chain alkyl, alkenyl, and alkynyl groups, and hydroxyl derivatives of such groups, and each R substituent bound to a carbon member is independently selected to the group consisting of H, C1-C20 straight or branched chain alkyl, alkenyl, and alkynyl groups, and hydroxyl derivatives of such groups.

17. The method of claim 16, each of the R substituents bound to a nitrogen is nothing, and each of the R substituents bound to a carbon is H.

18. The method of claim 1, said glycol ether being selected from the group consisting of glycol mono-, di-, and tri-alkylene ethers, glycol aryl ethers, and derivatives thereof.

19. The method of claim 18, said glycol ether selected from the group consisting of glycol C2-C6 monoalkylene ethers.

20. The method of claim 18, said glycol ether selected from the group consisting of glycol butyl ether, ethoxylated glycol butyl ether, and mixtures thereof.

21. The method of claim 1, said composition having a maximum water content of up to about 10% by volume.

22. The method of claim 1, said composition having a pH of from about 6-13.

23. The method of claim 22, said pH being from about 9-12.

24. The method of claim 1, including a mixture of triazines.

25. The method of claim 1, including a mixture of glycol ethers.

* * * * *